United States Patent [19]

Kulow

[11] Patent Number: 4,540,298

[45] Date of Patent: Sep. 10, 1985

[54] MANUALLY LOADED ENVELOPE FEEDER

[75] Inventor: Howard H. Kulow, Berea, Ohio

[73] Assignee: Rowan Corporation, Fairview Park, Ohio

[21] Appl. No.: 675,635

[22] Filed: Nov. 28, 1984

[51] Int. Cl.[3] ..... B41J 13/10

[52] U.S. Cl. ..... 400/635; 400/629; 271/2; 271/271

[58] Field of Search ..... 400/636.2, 625, 629, 400/634–636.1, 642, 624, 635, 634; 101/233; 271/2, 3, 271

[56] References Cited

U.S. PATENT DOCUMENTS

| | | | |
|---|---|---|---|
| 3,586,312 | 6/1971 | Sammons | 271/2 |
| 4,030,726 | 6/1977 | Biedermann | 400/635 |
| 4,143,987 | 3/1979 | Hansen et al. | 400/637.1 X |
| 4,222,557 | 9/1980 | Wu | 400/629 X |
| 4,362,100 | 12/1982 | Wu | 400/629 X |

*Primary Examiner*—E. H. Eickholt
*Attorney, Agent, or Firm*—David A. Burge

[57] ABSTRACT

An envelope feeder sequentially feeds envelopes from a loading station to a printing station of a conventional printer for addressing, and releases addressed envelopes at a discharge station. The feeder includes an upstanding housing that journals a platen roll at its lower end and an idler roll at its upper end. The feeder's platen roll replaces the printer's conventional platen roll and serves to drivingly connect the feeder to the printer. The housing has a front guide surface that faces forwardly with respect to the printer, and a rear guide surface that faces rearwardly. At least two transport belts have reaches that extend along the front and rear guide surfaces. The belts extend around and are held taut by the feeder's platen and idler rolls. Envelopes to be addressed are loaded manually, one at a time, at the loading station by opening a door to permit each new envelope to be positioned in engagement with the transport belts, whereupon the door is closed to assist in maintaining proper envelope positioning. The transport belts have lugs that are brought into engagement with trailing edge portions of newly loaded envelopes for moving envelopes along the travel path from the loading station to the printing and discharge stations as the belts are caused to move in response to rotation of the feeder's platen roll by the printer. The printing, discharge and loading stations are located at closely spaced positions along the front of the feeder, with the loading station above the printing station, and with the discharge station therebetween.

17 Claims, 4 Drawing Figures

MANUALLY LOADED ENVELOPE FEEDER

BACKGROUND OF THE INVENTION

1. Field of the Invention

The present invention relates to a manually loaded, platen-roll-driven envelope feeder for serially feeding envelopes from a loading station to a printing station of a conventional printer where the envelopes are addressed, and for removing addressed envelopes from the printing station for release at a discharge station, with the printing, discharge and loading stations being located at vertically spaced positions along a front side of the feeder, with the discharge station being above the printing station, and with the loading station being above the discharge station.

2. Prior Art

There has long been a need for a simple and inexpensive, yet reliable apparatus for sequentially feeding envelopes to and from the printing station of a printer for addressing. With the advent of automatic typewriters and programmable printers that can operate unattended, a number of proposals have been made to provide relatively complex, fully automated systems for feeding envelopes in a serial manner to and from a printing station of a printer.

One prior proposal has been to utilize continuous-form envelopes rather than individual envelopes, whereby an uninterrupted web of serially connected envelopes is fed around the platen roll of a printer. This proposal has suffered from several drawbacks including the dramatically increased cost of continuous-form envelopes.

Another proposal has been to provide a feeding unit in the form of an appliance that is positioned adjacent to the platen roll of a printer for sequentially introducing envelopes to the printer at one side of the printer's platen roll, and for removing printed envelopes from the other side of the platen roll. This proposal lacks a positive-feed transport system for reliably conveying envelopes around the platen roll for precise positioning at a printing station, whereby it is not uncommon for envelopes to misfeed or fail to feed around the platen roll of the printer.

Still another proposal has called for the use of a relatively complex feeder unit which mechanically interconnects with the platen roll of a printer, and which has a number of power-operated, electrically controlled components that are caused to cycle through a staged feeding sequence in response to rotation of the platen roll. By this arrangement, envelopes are fed from a supply hopper through a printing station to a receiving hopper, and a programmable printer initiates the printing of a new address at the exact time when the feeder has properly positioned a new envelope in the printing station, whereby unattended automatic addressing of a large number of envelopes can be reliably effected.

The apparatus that is used to implement this latter proposal makes use of a plurality of individual feeding mechanisms to effect a multi-step, stage by stage feeding of envelopes from a supply hopper through a printing station to a receiving hopper. A dispensing mechanism supports the supply stack of envelopes and dispenses them one at a time from the bottom of the stack. A positioning mechanism receives envelopes from the dispensing mechanism and positions them one at a time along the path of travel of a pair of transport belts. A transport mechanism includes the transport belts and other structure for defining the travel path such that the travel path extends around the printer's platen roll. The belts have lugs which engage the trailing edge of an envelope to be fed, and positively feed the envelope along the travel path to and from the printing station. Additional feeding structure cooperates with the transport belts to move addressed envelopes from the printing station to the receiving hopper.

A drawback of the foregoing proposals is that they do not address the need which remains for a very simple and inexpensive, manually loaded, envelope feeder for sequentially delivering envelopes to and from a printing station of a conventional printer such as a typewriter.

SUMMARY OF THE INVENTION

The present invention overcomes the foregoing and other drawbacks by providing a simple and inexpensive, manually loaded feeder for serially feeding envelopes around a platen roll for addressing in a printing station of a printer.

In accordance with the preferred practice of the present invention, an envelope feeder is provided for sequentially feeding envelopes from a loading station to a printing station of a conventional printer where the envelopes are addressed, and for discharging addressed envelopes at a discharge station. The feeder includes an upstanding housing that journals a platen roll at its lower end, and an idler roll at its upper end. The feeder's platen roll replaces the printer's conventional platen roll and serves to drivingly connect the feeder to the printer. The housing has a front guide surface that faces forwardly with respect to the printer, and a rear guide surface that faces rearwardly. At least two transport belts have reaches that extend along the front and rear guide surfaces. The belts extend around and are held taut by the feeder's platen and idler rolls. Envelopes to be addressed are loaded manually, one at a time, at the loading station by opening a door to permit each new envelope to be positioned in engagement with the transport belts, whereupon the door is closed to assist in maintaining proper positioning of each newly loaded envelope. The transport belts have lugs that are brought into engagement with trailing edge portions of newly loaded envelopes for moving envelopes sequentially along the travel path from the loading station to the printing and discharge stations as the belts are caused to move in response to rotation of the feeder's platen roll by the printer. Guide structures cooperate with the transport belts and with the housing to maintain proper orientation of envelopes for movement along the travel path.

A feature of envelope feeders that incorporate the preferred practice of the present invention is the advantageous relative arrangement they provide of their loading, printing and discharge stations. These three stations are arranged in closely spaced relationship along the front side of the feeder so that, as an operator manually loads an envelope to be addressed, he or she can grasp an addressed envelope as it is being discharged by the feeder, and can simultaneously monitor the printing operation that is taking place at the printing station. If the printing is being done manually as by using a typewriter, the closely spaced, vertically stacked arrangement of the printing, discharge and loading stations minimizes the extent of the physical movements that must be executed by an operator in order to load, retrieve and imprint envelopes as the addressing operation proceeds.

Still another feature lies in the provision of a very lightweight, simple and inexpensive envelope feeder that takes the form of a modular unit which can be held in one hand by an operator for insertion into or removal from the platen roll support region of a printer. The feeder unit is small enough and sufficiently light in weight that it can be manipulated and positioned with one hand while an operator is seated normally in front of a typewriter or printer, and can be substituted easily for the original platen roll of the typewriter or printer.

A further feature lies in the versatile design of the feeder that enables it to be used with typewriters and printers of a wide variety of types. Because the feeder does not electrically interconnect with typewriters or printers, installation is not complicated by a need to make a series of proper electrical connections between the feeder and the printer. Because the feeder is light in weight and does not unduly load the mechanism of a typewriter or printer on which it is installed, and because the unit is so easily installed on and removed from a typewriter or printer, operators have no hesitancy to use the feeder or to move it from one machine to another as it can be used to enhance productivity. Because the unit is provided with pair of adjustable legs that are capable of steadying the feeder atop typewriters and printers of a substantially any configuration, installation of the unit reduces itself to a simple matter of replacing a platen with the feeder, and setting the adjustable legs to steady the feeder for operation.

BRIEF DESCRIPTION OF THE DRAWINGS

These and other features and a fuller understanding of the invention may be had by referring to the following detailed description and claims taken in conjunction with the accompanying drawings wherein:

DESCRIPTION OF THE PREFERRED EMBODIMENT

Figure 1:
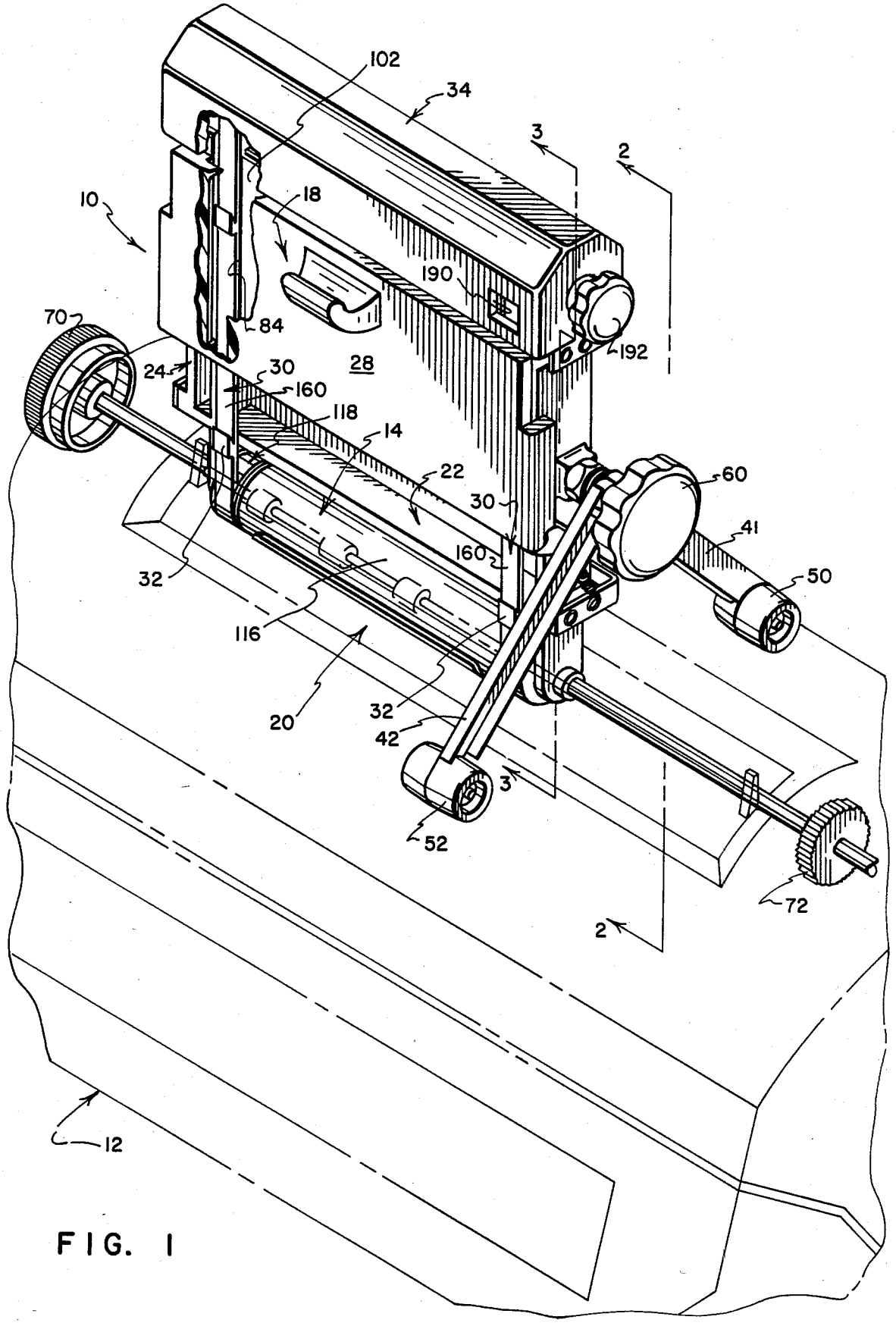
FIG. 1 is a perspective view of an envelope feeder embodying the preferred practice of the present invention, with the feeder being shown connected to a conventional printer which is outlined in phantom.
Figure 2:
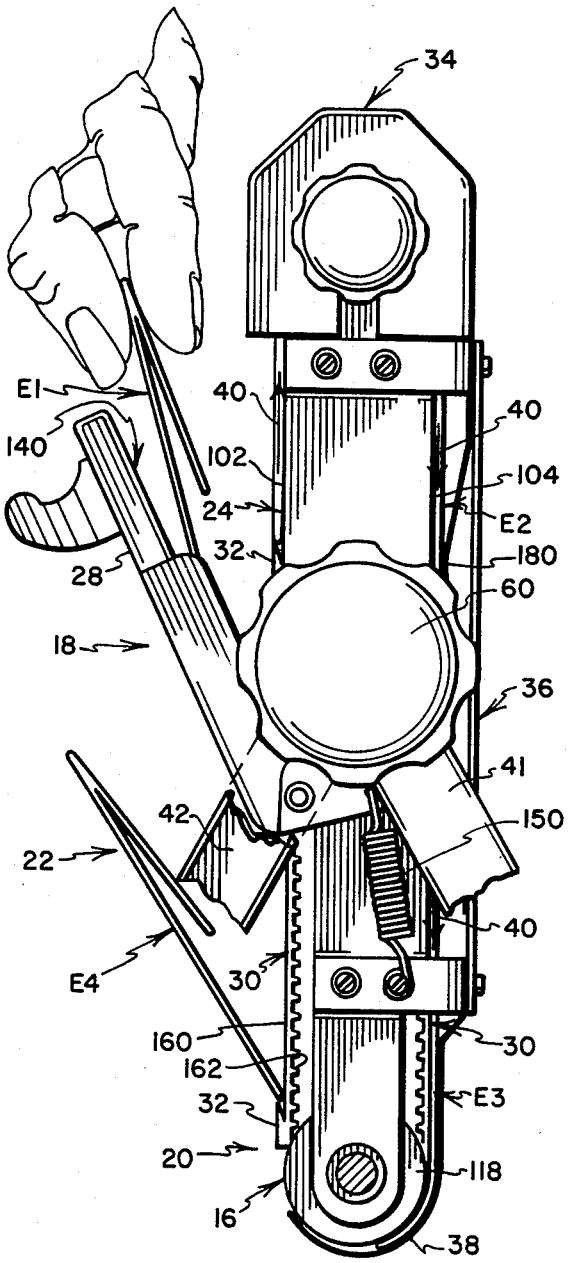
FIG. 2 is a sectional view as seen from a plane indicated by a line 2—2 in FIG. 1, but with an envelope loading station door shown open and with portions of the feeder's supporting legs being broken away.
Figure 3:
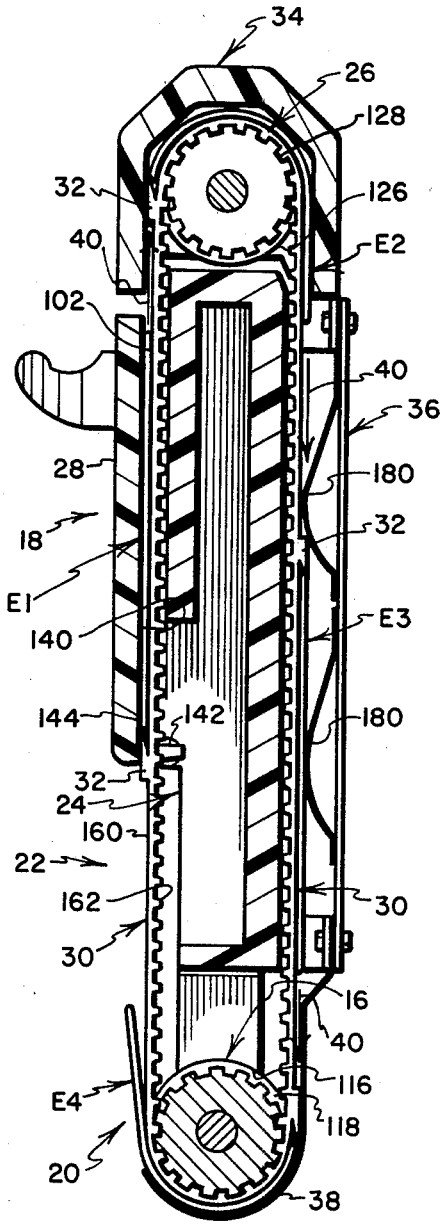
FIG. 3 is a sectional view as seen from a plane indicated by a line 3—3 in FIG. 1; and, FIG. 4 is a foreshortened rear side elevational view of portions of the feeder.

Referring to FIGS. 1–3, an envelope feeder 10 embodying the preferred practice of the present invention is depicted as being positioned atop a conventional printer or typewriter 12 that is shown in phantom in FIG. 1. While the printer or typewriter 12 is illustrated as taking the form of a conventional programmable printer, it will be understood that such feeders 10 as embody the preferred practice of the present invention may be utilized with any of a variety of conventional typewriters and printers so long as (1) the printer or typewriter employs a platen roll that can be removed therefrom and replaced by a platen roll 16 which forms a part of the feeder 10, and (2) the printer or typewriter 12 defines what will be referred to as a "printing station" 20 at a location in front of its removable platen roll wherein pieces of stationery may be positioned for imprinting.

In brief overview, the feeder 10 operates by serially feeding envelopes E1, E2, E3, E4 (see FIGS. 2 and 3) from a loading station 18 along a path of travel which is indicated by arrows 40 to the printing station 20, and thence to a discharge station 22. The travel path 40 is defined, in part, by a pair of transport belts 30 such that the travel path 40 extends upwardly from the loading station 18 along a front guide surface 102 of a main housing 24, around an idler roll 26, downwardly along a rear guide surface 104 of the main housing 24, around the replacement platen roll 16, and upwardly from the printing station 20 to the discharge station 22. Movement of envelopes E1, E2, E3, E4, from the loading station 18 to the printing and discharge stations 20, 22 is effected by lug-like projections 32 that are carried on the transport belts 30 for engaging trailing edge portions of the envelopes E1, E2, E3, E4, to push these envelopes along the travel path 40.

Because the transport belts 30 are provided with a plurality of the lug-like projections 32 at spaced along their lengths, the belts 30 are able to simultaneously serially feed a plurality of the envelopes E1, E2, E3, E4 along the travel path 40. In this regard, it will be seen in FIG. 2 that, as one of the envelopes E1 is being inserted into the loading station 18, another of the envelopes E4 is being discharged at the discharge station 22, and still others of the envelopes E2, E3 are at other locations along the travel path 40. In FIG. 3, an envelope E1 is at the loading station 18, envelopes E2 and E3 are along rearward portions of the travel path 40, and an envelope E4 is positioned for imprinting at the printing station 20.

An envelope feeding cycle is initiated by opening a door 28 at the loading station 18 to manually introduce an envelope E1 into the loading station 18, as is depicted in FIG. 2. As is best seen in FIG. 3, the door 28 has a rearwardly facing guide surface 140, and a rearwardly extending base 142 that defines an upwardly facing stop surface 144. The door 28 is pivotally connected to the housing 24 for pivotal movement between the open and closed positions of FIGS. 2 and 3, respectively. A pair of tension coil springs 150 bias the door 28 toward its closed position shown in FIGS. 1 and 3.

As a newly inserted envelope E1 is positioned in the loading station 18, it comes to rest against both the guide surface 140 and the stop surface 144 of the door 28. As the door 28 is closed, the newly inserted envelope E1 is caused to assume an upstanding orientation that extends along the travel path 40. The envelope E1 is supported in this upstanding orientation by virtue of its being positioned between the guide surfaces 140, 102 of the door 28 and the housing 24, respectively, and by virtue of its lower or "trailing" edge resting in engagement with the stop surface 144.

After a newly loaded envelope E1 has been positioned as described along the travel path 40 at the loading station 18, a set of the lug-like projections 32 on the transport belts 30 are brought into engagement with lower or "trailing" edge portions of the envelope E1, whereby the envelope E1 is caused to move with the belts 30 in an upward direction along the travel path 40, i.e., along the front guide surface 102 of the housing. An upper guide structure 34 overlies the idler roll 26 and, as is best seen in FIG. 3, cooperates with the idler roll 26 and with the transport belts 30 to define a substantially U-shaped portion of the travel path 40 that causes envelopes that are moving along this portion of the travel path 40, as depicted by the envelope E2 in FIG. 3, to be reeved around the idler roll 26 for subsequent direction downwardly along the rear guide surface 104 of the housing 24. A guide structure 36 extends along the rear guide surface 104 of the housing 24 and has finger-like members 180 that engage envelopes (such as the envelope E3 depicted in FIG. 3) as they move along the rear guide surface 104 and bias these envelopes toward the rear guide surface 104 as they move along the travel path 40 toward the replacement platen roll 16. A U-shaped guide 38 extends around lowermost portions of the replacement platen roll 16 and cooperates therewith to direct envelopes such as the envelope E4 depicted in FIG. 3 to move along a U-shaped portion of the travel path 40 around the platen roll 16 to position the envelope E4 in the printing station 20.

Once an envelope has been positioned in the printing station 20, it is imprinted, i.e., addressed by the imprinting mechanism of the printer 12. When the imprinting operation has been completed, continued movement of the transport belts 30 along the travel path 40 will cause an addressed envelope, such as the envelope E4 depicted in FIG. 2, to move upwardly from the printing station 20 for removal at the discharge station 22.

Figure 4:
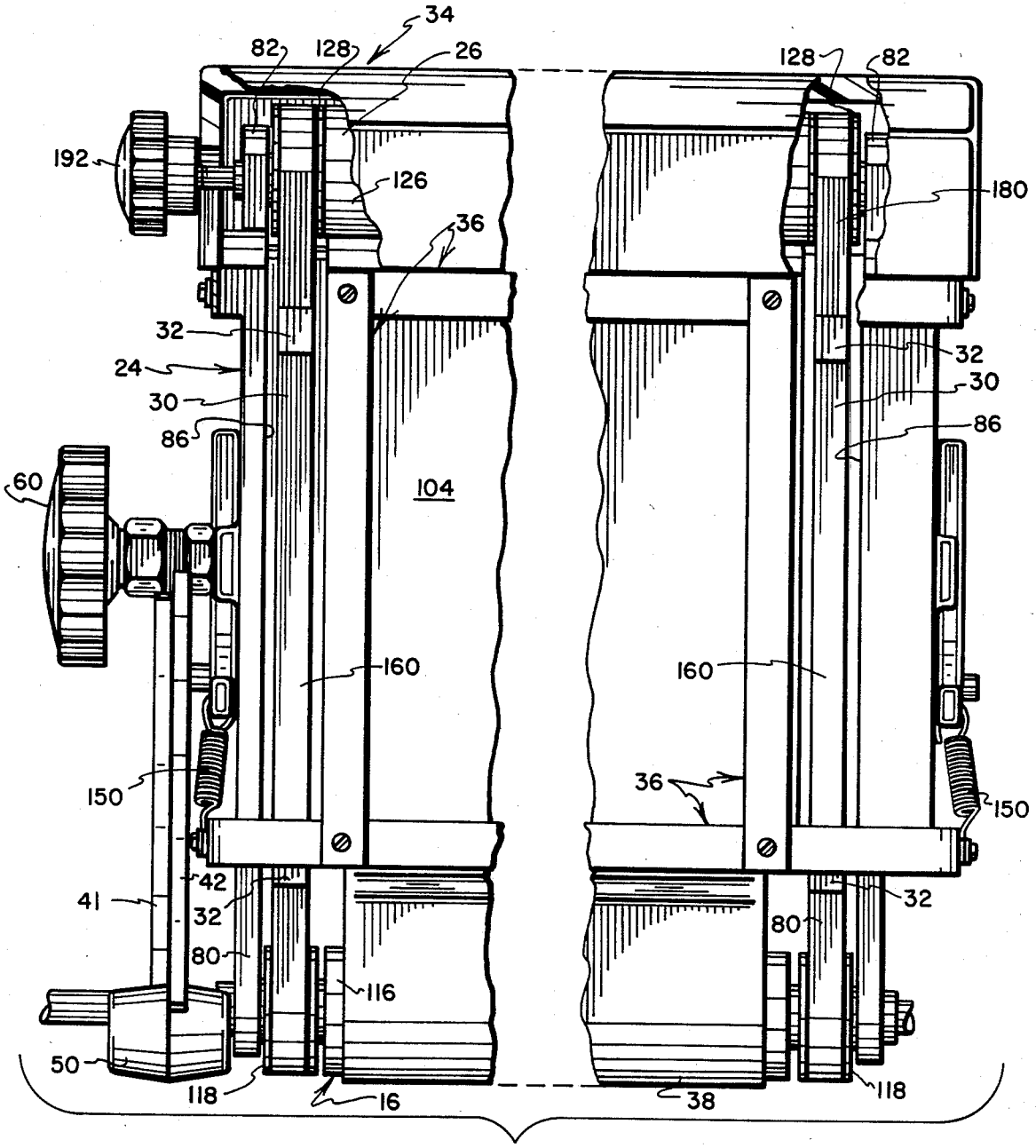

The housing 24 is configured to extend principally within the confines of the loops that are defined by the transport belts 30. As is best seen in FIG. 4, the housing 24 has a pair of depending legs 80 that journal the replacement platen roll 16 near the lower end of the housing 24. A similar set of upwardly extending legs 82 journal the idler roll 26 near the upper end of the housing 24. Intermediate the locations of the platen and idler rolls 16, 26, the housing 24 has portions that define the front and rear guide surfaces 102, 104. Grooves 84, 86 are formed in the front and rear guide surfaces (only one of the front guide surface grooves 84 is depicted in FIG. 1) to provide channels of passage for the transport belts 30 such that front surfaces 160 of the transport belts 30 can extend substantially contiguously with, i.e., in substantially the same planes as, the front and rear guide surfaces 102, 104.

The platen and idler rolls 16, 26 are depicted as having substantially cylindrical center sections 116, 126 that extend between the transport belts 30. Timing belt pulleys 118, 128 are carried by the platen and idler rolls 16, 26 at opposite ends of their cylindrical center portions 116, 126. The transport belts 30 have inner surfaces 162 that are toothed to drivingly engage the toothed timing belt pulleys 118, 128 so that the transport belts 30 drivingly interconnect with the toothed timing belt pulleys 118, 128 and serve to drivingly interconnect the platen and idler rolls 16, 26.

Referring to FIG. 1, an opening 190 is formed through the front wall of the upper guide structure 34 to permit a small portion of one of the transport belts 30 to be viewed. In preferred practice, spaced markings (not shown) are provided on the outer surfaces of the transport belts 30 so that, as one of these markings comes into view through the opening 190, the operator will know the relative positioning of the various lug-like projections 32 that are carried on the transport belts 30. By rotating a knob 192 that is connected to the idler roll 26, a desired marking on one of the transport belts 30 can be brought into view through the opening 190, whereby an operator will know that the lugs 32 on the transport belts 30 are oriented in an advantageous position for initiating operation of the feeder 10. By causing operation of the feeder 10 to be initiated with the lugs 32 of the transport belts 30 in a predetermined, advantageous position, the operator will be assured that an envelope E1 can immediately be loaded into the loading station 18 for initiating a feeding cycle that will begin moving envelopes serially along the travel path 40 to the printing and discharge stations 20, 22.

A feature of the feeder 10 is that a pair of legs 41, 42 are adjustably connected to the housing 24, and are provided with resilient feet 50, 52 that can be brought into engagement with upper surface portions of a typewriter or printer 12 to steady the feeder 10 atop a typewriter or printer 12 on which the feeder 10 is installed. A knob 60 is provided for selectively loosening the connection between the legs 41, 42 and the housing 24 to enable the legs 41, 42 to be positioned as desired, and to tighten the connection between the legs 41, 42 and the housing 24 once the desired positioning of the legs 41, 42 has been attained.

The platen roll 16 that forms a part of the feeder 10 is substantially identical in configuration to the platen roll that it replaces in the feeder 12 insofar as its length and its connecting and drive formations are concerned. In this regard, referring to FIG. 1, the replacement platen roll 16 is depicted as including a positioning knob 70 and a drive sprocket 72 which constitute identical counterparts to the removable platen roll (not shown) of the printer 12 that is replaced by the substitute platen roll 16.

In preferred practice, the housing 24 may be formed as a sheet metal assembly, as a die cast metal member, as an injection molded plastics structure, or from other suitable materials as may be desired to render the housing 24 light in weight and durable in construction. As will be apparent to those skilled in the art, such connections as are made between the housing 24 and other operable components of the feeder 10 may be provided with suitable bushings, bearings, or other conventional connectors to permit smooth relative movement of the described components and to facilitate ease of operation of the feeder 10.

As will be apparent from the foregoing description, the feeder 10 provides a simple and inexpensive lightweight modular unit that can be substituted quite easily for a platen roll of a conventional typewriter or printer. Because the feeder 10 does not electrically interconnect with a typewriter or printer on which it is installed, installation is not complicated by a need to make a series of electrical connections between the feeder or typewriter printer on which it is installed. Because the feeder 10 is light in weight and does not unduly load the mechanism of a typewriter or printer on which it is installed, and because the feeder 10 is so easily installed on and removed from a typewriter or printer, operators have no hesitancy to use the feeder or to move it from one machine to another as can be done to enhance productivity. Because the unit is provided with a pair of adjustable legs that are capable of steadying the feeder atop typewriters and printers of substantially any configuration, installation of the feeder 10 reduces itself to a simple matter of replacing a platen with the feeder, and of setting the adjustable legs to steady the feeder for operation.

Moreover, by providing an arrangement of loading, printing and discharge stations that are closely spaced and extend along the front side of the feeder 10, an operator can easily attend to the physical movements that are needed to load, receive, and imprint envelopes. If the printing is being done automatically at the printing station 20 as when a programmed printer is being utilized, the operator can easily attend to loading envelopes one at a time at the loading station 18 while receiving envelopes one at a time from the discharge station 22 while simultaneously monitoring imprinting at the printing station 20. If the printing is being done manually as by using a typewriter, the closely spaced, vertically stacked arrangement of the loading, printing, discharge and loading stations 18, 20, 22 minimizes the extent of the physical movements that must be executed by an operator in order to load, retrieve and imprint envelopes as the addressing operation proceeds.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. An envelope feeder for use with a printer, wherein (1) the printer is of the type that has a printing station wherein pieces of stationery may be positioned for printing, (2) the printer has a platen roll that is rotatable about a first axis of rotation that is fixed relative to drive components of the printer when the platen roll is drivingly connected to such drive components of the printer, and (3) the printer's platen roll is removable from connection with such drive components of the printer, the envelope feeder being (1) substitutable for the printer's removable platen roll, (2) connectable to drive components of the printer, and (3) operable to serially feed envelopes to the printer's printing station in response to operation of drive components of the printer so that envelopes may be addressed one at a time while they are in the printing station, the envelope feeder comprising:

(a) housing means including an elongate upstanding housing having structure that defines an upper end region, a lower end region, and opposed front and rear guide surfaces that extend between the upper and lower end regions;

(b) replacement platen roll means rotatably connected to the lower end region of the housing and including a replacement platen roll that is configured to be received by and drivingly connected to drive components of the printer in substitution for the printer's removable platen roll, and of being rotated by the printer's drive components about the first axis of rotation;

(c) idler roll means including an idler roll that is rotatably connected to the upper end region of the housing for rotation about a second axis of rotation that extends substantially parallel to the first axis of rotation;

(d) transport belt means including at least two transport belts that have reaches which extend along the front and rear guide surfaces of the housing, and that extend around and are held taut by the replacement platen roll and the idler roll, the transport belts having outer surfaces that cooperate to define an endless loop travel path which extends along the front and rear guide surfaces of the housing means and around the replacement platen roll and the idler roll;

(e) receiving means defining a loading station located along the front guide surface of the housing means, the receiving means including door means movably connected to the housing means for pivotal movement relative thereto between an open position wherein an envelope to be addressed can be inserted between the door means and the front guide surface, and a closed position wherein an inner surface of the door means extends parallel to the front guide surface of the housing means and cooperates therewith to position an inserted envelope along the travel path;

(f) drive formation means carried by the transport belts for engaging trailing edge portions of envelopes that are positioned along the travel path for moving envelopes sequentially along the travel path from the loading station to the printing station and thence to a discharge station as the belts are caused to move in response to rotation of the replacement platen roll by the printer;

(g) guide means for cooperating with the transport belts, with the replacement platen roll, with the idler roll, and with the housing means to maintain positioning of envelopes along the travel path as the envelopes are being moved from the loading station to the printing station and thence to the discharge station; and, (h) the printing, discharge and loading stations being located forwardly of the front guide surface at closely spaced positions along the travel path, with the loading station being located above the printing station, and with the discharge station being located between the loading and printing stations, whereby an operator can readily attend to both manual loading of envelopes one at a time at the loading station and manual removal of envelopes one at a time at the discharge station while also monitoring the addressing of envelopes as it takes place at the printing station.

2. The envelope feeder of claim 1 wherein:

(a) the replacement platen roll has central portion that defines a generally cylindrical surface of a diameter that is substantially the same as the diameter of the removable platen roll of the printer;

(b) the idler roll has a central portion that defines a generally cylindrical surface of a diameter that is substantially the same as the diameter of the replacement platen roll;

(c) the front and rear guide surfaces of the housing means extend in planes that are substantially parallel to each other and are spaced apart by a distance that is substantially the same as the diameters of the replacement platen roll;

(d) the replacement platen roll and the idler roll have toothed drive pulley means at opposed ends of their respective central portions for receiving the transport belts;

(e) the transport belts have inner drive surfaces that are toothed and that drivingly engage the toothed drive pulley means to drivingly interconnect the replacement platen roll, the idler roll and the transport belts; and, (f) the outer surfaces of the transport belts having portions that extend substantially contiguously with the central portion of the replacement platen roll, with the central portion of the idler roll, and with the front and rear guide surfaces of the housing means;

(g) whereby the central portions of the replacement platen roll and the idler roll, and the front and rear guide surfaces of the housing means cooperate with the outer surfaces of the transport belts to define portions of a path of movement that is followed by envelopes in moving from the loading station to the printing and discharge stations.

3. The envelope feeder of claim 2 wherein the formation means on the transport belts includes a series of projecting lug-like projections that are spaced along the length of each of the transport belts and that project from the outer surfaces of the transport belts for simultaneously serially feeding a plurality of discrete envelopes along the travel path.

4. The envelope feeder of claim 3 wherein each of the transport belts is formed as a one-piece endless band with its associated lug-like projections being formed integrally therewith.

5. The envelope feeder of claim 1 wherein the guide means includes a U-shaped paper guide configured to underlie the replacement platen roll and to assist envelopes being fed along the travel path in feeding around the replacement platen roll.

6. The envelope feeder of claim 1 wherein the receiving means includes stop means carried by the door means for assisting in orienting an envelope which has been introduced at the loading station to properly position its trailing edge along the travel path for engagement by the formation means of the transport belts.

7. The envelope feeder of claim 1 wherein the receiving means additionally includes biasing means for biasing the door means toward its closed position.

8. The envelope feeder of claim 1 wherein the guide means includes a plurality of finger-like members extending along the travel path for biasing envelopes moving therealong into engagement with the rear guide surface of the housing means.

9. The envelope feeder of claim 1 wherein the guide means includes structure defining a generally U-shaped enclosure that is connected to the housing means and extends about the idler roll for assisting in guiding envelopes moving along the travel path as they feed around the idler roll.

10. An envelope feeder for use with a printer of the type that has a printing station wherein pieces of stationery may be positioned for printing, and a removable platen roll that is rotatable about a first axis of rotation relative to drive components of the printer, the envelope feeder being substitutable for the printer's removable platen roll, being connectable to drive components of the printer, and being operable to serially feed envelopes to the printer's printing station in response to operation of drive components of the printer so that envelopes may be addressed one at a time while they are in the printing station, the envelope feeder comprising:

(a) housing means including an elongate upstanding housing having structure that defines an upper end region, a lower end region, and opposed front and rear guide surfaces that extend between the upper and lower end regions, the front and rear guide surfaces extending substantially parallel to each other and each having a spaced pair of grooves formed therein that extend between the upper and lower end regions;

(b) replacement platen roll means rotatably connected to the lower end region of the housing and including a replacement platen roll that is configured to be received by and drivingly connected to drive components of the printer in substitution for the printer's removable platen roll, and to be rotated by the printer's drive components about the first axis of rotation;

(c) idler roll means including an idler roll that is rotatably connected to the upper end region of the housing for rotation about a second axis of rotation that extends substantially parallel to the first axis of rotation;

(d) each of the replacement platen roll and the idler roll having a generally cylindrical central portion with toothed drive pulley means located at opposed ends of the central portions, the drive pulley means being aligned with the grooves formed in the front and rear guide surfaces of the housing means;

(e) transport belt means including at least two transport belts that have reaches which extend along the grooves of the front and rear guide surfaces of the housing, and that extend around and are held taut by the toothed drive pulley means, the transport belts having outer surface portions that extend substantially contiguously with the front and rear guide surfaces of the housing means and with the cylindrical central portion of the replacement platen roll, to cooperate therewith in defining a travel path that extends along the front and rear guide surfaces of the housing means and around the replacement platen roll and the idler roll, the belts additionally having inner surfaces that are toothed to drivingly engage the toothed drive pulley means to drivingly interconnect the replacement platen roll and the idler roll;

(f) receiving means defining a loading station located along the front guide surface of the housing means, the receiving means including door means movably connected to the housing means for pivotal movement relative thereto between an open position wherein an envelope to be addressed can be inserted between the door means and the front guide surface, and a closed position wherein an inner guide surface defined by the door means extends parallel to the front guide surface of the housing means and cooperates therewith to position an inserted envelope along the travel path;

(g) drive formation means carried by the transport belts for engaging trailing edge portions of envelopes that are positioned along the travel path for moving envelopes sequentially along the travel path from the loading station to the printing station and thence to a discharge station as the belts are caused to move in response to rotation of the replacement platen roll by the printer;

(h) guide means for cooperating with the transport belts, with the replacement platen roll, with the idler roll, and with the housing means to maintain positioning of envelopes along the travel path as the envelopes are being moved from the loading station to the printing station and thence to the discharge station; and, (i) the printing, discharge and loading stations being located forwardly with respect to the front guide surface and at closely spaced positions along the travel path, with the loading station being located above the printing station, and with the discharge station being located between the loading and printing stations, whereby an operator can readily attend to both manual loading of envelopes one at a time at the loading station and manual removal of envelopes one at a time at the discharge station while also monitoring the addressing of envelopes as it takes place at the printing station.

11. The envelope feeder of claim 10 wherein the formation means on the transport belts includes a series of formations that are spaced along the length of each of the transport belts and that project from the outer surfaces of the transport belts for simultaneously serially feeding a plurality of discrete envelopes along the travel path.

12. The envelope feeder of claim 11 wherein each of the transport belts is formed as a one-piece endless band with its associated formation means including lug-like projections that are formed integrally therewith.

13. The envelope feeder of claim 10 wherein the guide means includes a U-shaped paper guide configured to underlie the replacement platen roll and to assist envelopes being fed along the travel path in feeding around the replacement platen roll.

14. The envelope feeder of claim 10 wherein the receiving means includes stop means carried by the door means for assisting in orienting a newly introduced envelope for proper positioning of its trailing edge along the travel path for engagement by the formation means of the transport belts.

15. The envelope feeder of claim 10 wherein the receiving means additionally includes biasing means for biasing the door means toward its closed position.

16. The envelope feeder of claim 10 wherein the guide means includes a plurality of finger-like members that extend along the travel path for biasing envelopes moving therealong into engagement with the rear guide surface of the housing means.

17. The envelope feeder of claim 10 wherein the guide means includes structure defining a generally U-shaped enclosure that is connected to the housing means and extends about the idler roll for assisting in guiding envelopes moving along the travel path as they feed around the idler roll.

* * * * *